US011777282B2

(12) United States Patent
Ma

(10) Patent No.: US 11,777,282 B2
(45) Date of Patent: Oct. 3, 2023

(54) ELECTRODE MATERIAL FOR A SPARK PLUG

(71) Applicant: Federal-Mogul Ignition LLC, Southfield, MI (US)

(72) Inventor: Shuwei Ma, Ann Arbor, MI (US)

(73) Assignee: FEDERAL-MOGUL IGNITION LLC, Southfield, MI (US)

( * ) Notice: Subject to any disclaimer, the term of this patent is extended or adjusted under 35 U.S.C. 154(b) by 122 days.

(21) Appl. No.: 17/635,834

(22) PCT Filed: Sep. 4, 2020

(86) PCT No.: PCT/US2020/049358
§ 371 (c)(1),
(2) Date: Feb. 16, 2022

(87) PCT Pub. No.: WO2021/046320
PCT Pub. Date: Mar. 11, 2021

(65) Prior Publication Data

US 2022/0302682 A1 Sep. 22, 2022

Related U.S. Application Data

(60) Provisional application No. 62/896,900, filed on Sep. 6, 2019.

(51) Int. Cl.
*H01T 13/39* (2006.01)

(52) U.S. Cl.
CPC ..... *H01T 13/39* (2013.01)

(58) Field of Classification Search
CPC ..... H01T 13/39
(Continued)

(56) References Cited

U.S. PATENT DOCUMENTS 4,853,582 A 8/1989 Sato et al.
8,482,188 B1 7/2013 Ma
(Continued)

FOREIGN PATENT DOCUMENTS

CA 2320415 A1 3/2001
JP 2007214136 A 8/2007
(Continued)

OTHER PUBLICATIONS

Alloy ASTM F-15 aka Kovar Controlled Expansion Alloys; ED Fagan Inc.
(Continued)

*Primary Examiner* — Karabi Guharay
(74) *Attorney, Agent, or Firm* — REISING ETHINGTON, P.C.

(57) ABSTRACT

An electrode material for a spark plug includes 22-46 wt % iron (Fe), inclusive, 20-40 wt % nickel (Ni), inclusive, 13-42 wt % cobalt (Co), inclusive, and one or more additional elements selected from aluminum (Al), titanium (Ti), chromium (Cr), boron (B), and niobium (Nb), wherein the electrode material has a coefficient of thermal expansion (CTE) from room temperature to 200° C. that is less than or equal to $11.0\times10^{-6}/°$ C. In another example, the electrode material includes greater than or equal to 32 wt % iron (Fe), greater than or equal to 36 wt % nickel (Ni), and one or more additional elements selected from aluminum (Al), chromium (Cr), and cobalt (Co). In advantageous embodiments, the electrode material includes greater than or equal to 22 wt % cobalt (Co). Replacing nickel with a higher percentage of cobalt can help reduce the coefficient of thermal expansion (CTE) of the electrode material.

20 Claims, 2 Drawing Sheets

(58) Field of Classification Search
USPC ..... 313/141
See application file for complete search history.

(56) References Cited

U.S. PATENT DOCUMENTS

| | | | |
|---|---|---|---|
| 2002/0130602 | A1* | 9/2002 | Kanao ..... H01T 13/39 313/141 |
| 2002/0158559 | A1 | 10/2002 | Sugiyama et al. |
| 2003/0085644 | A1 | 5/2003 | Sugiyama et al. |
| 2005/0264152 | A1 | 12/2005 | Kanao |
| 2007/0159046 | A1 | 7/2007 | Yoshimoto et al. |
| 2007/0290591 | A1 | 12/2007 | Lykowski et al. |
| 2009/0189502 | A1 | 7/2009 | Suzuki et al. |
| 2009/0321408 | A1 | 12/2009 | Kern et al. |
| 2011/0121712 | A1 | 5/2011 | Ma |
| 2011/0163653 | A1 | 7/2011 | Torii et al. |
| 2013/0088139 | A1 | 4/2013 | Yoshimoto et al. |
| 2013/0187530 | A1 | 7/2013 | Desalvo |

FOREIGN PATENT DOCUMENTS

| | | | |
|---|---|---|---|
| JP | 2011113836 | A | 6/2011 |
| RU | 2497251 | C1 | 10/2013 |
| WO | WO2007051677 | A1 | 5/2004 |

OTHER PUBLICATIONS

Special Metals; Inconel Alloy 718; Publication No. SMC-045.
International Search Report and Written Opinion issued for PCT/US2020/049358 dated Dec. 15, 2020.
International Preliminary Report on Patentability issued for PCT/US2020/049358 dated Mar. 17, 2022; 6 pages.

* cited by examiner

ELECTRODE MATERIAL FOR A SPARK PLUG

CROSS-REFERENCE TO RELATED APPLICATION

This application claims the benefit of U.S. Provisional Application No. 62/896,900 filed Sep. 6, 2019, which is hereby incorporated by reference in its entirety.

FIELD

This invention generally relates to spark plugs and other ignition devices for internal combustion engines and, in particular, to materials for spark plug electrodes.

BACKGROUND

Precious metal tips are typically mounted to spark plug electrodes to improve their erosion performance. However, since there is often a large mismatch in the coefficients of thermal expansion (CTEs) between the electrode and the precious metal tips, the precious metal tips can crack at the weld interface and fall off in the intense thermally cyclic engine environment. An electrode material with a low CTE can help alleviate these problems, and the low CTE material should also have a low shear modulus with high oxidation and corrosion resistance to perform optimally.

SUMMARY

According to one embodiment, there is provided a spark plug comprising a shell, an insulator disposed at least partially within the shell, a center electrode disposed at least partially within the insulator, and a ground electrode configured to form a spark gap that is located between the ground electrode and the center electrode. An electrode material for the center electrode, for the ground electrode, or for both the center electrode and the ground electrode includes 22-46 wt % iron (Fe), inclusive, 20-40 wt % nickel (Ni), inclusive, 13-42 wt % cobalt (Co), inclusive, and one or more additional elements selected from aluminum (Al), titanium (Ti), chromium (Cr), boron (B), and niobium (Nb). The electrode material has a coefficient of thermal expansion (CTE) from room temperature to 200° C. that is less than or equal to $11.0\times10^{-6}/°$ C.

In some embodiments, the electrode material includes greater than or equal to 22 wt % cobalt (Co).

In some embodiments, the electrode material includes 22-29 wt % iron (Fe), inclusive, 24-32 wt % nickel (Ni), inclusive, 28-42 wt % cobalt (Co), inclusive, 3-7 wt % aluminum (Al), inclusive, 0.05-0.5 wt % titanium (Ti), inclusive, 2-4 wt % chromium (Cr), inclusive, 0.002-0.015 wt % boron (B), inclusive, and 2-4 wt % niobium (Nb), inclusive.

In some embodiments, the coefficient of thermal expansion (CTE) from room temperature to 200° C. is between $10.10\text{-}10.35\times10^{-6}/°$ C., inclusive.

In some embodiments, the electrode material has a coefficient of thermal expansion (CTE) from room temperature to 800° C. that is between $14.0\text{-}14.4\times10^{-6}/°$ C., inclusive.

In some embodiments, the electrode material includes 35-45 wt % iron (Fe), inclusive, 20-30 wt % nickel (Ni), inclusive, 22-35 wt % cobalt (Co), inclusive, 0.5-2 wt % aluminum (Al), inclusive, and 4-7 wt % chromium (Cr), inclusive.

In some embodiments, the electrode material has a coefficient of thermal expansion (CTE) from room temperature to 200° C. that is less than or equal to $8.0\times10^{-6}/°$ C.

In some embodiments, the electrode material has a coefficient of thermal expansion (CTE) from room temperature to 800° C. that is less than or equal to $15.0\times10^{-6}/°$ C.

In some embodiments, the electrode material includes 32-46 wt % iron (Fe), inclusive, 36-40 wt % nickel (Ni), inclusive, 13-17 wt % cobalt (Co), inclusive, 2-6 wt % aluminum (Al), inclusive, 1-1.85 wt % titanium (Ti), inclusive, and 2.4-3.5 wt % niobium (Nb), inclusive.

In some embodiments, the electrode material has a coefficient of thermal expansion (CTE) from room temperature to 425° C. that is between $7\text{-}8\times10^{-6}/°$ C., inclusive.

In some embodiments, the electrode material has a coefficient of thermal expansion (CTE) from room temperature to 800° C. that is less than or equal to $12.0\times10^{-6}/°$ C.

In some embodiments, a firing tip made from a precious metal based material is attached to the ground electrode or the center electrode, wherein the precious metal based material has a coefficient of thermal expansion (CTE) from room temperature to 200° C., and wherein a ratio of the (CTE) for the precious metal based material to the CTE of the electrode material is less than 2.0.

According to one embodiment, there is provided a spark plug comprising a shell, an insulator disposed at least partially within the shell, a center electrode disposed at least partially within the insulator, and a ground electrode configured to form a spark gap that is located between the ground electrode and the center electrode. An electrode material for the center electrode, for the ground electrode, or for both the center electrode and the ground electrode includes greater than or equal to 22 wt % iron (Fe), greater than or equal to 20 wt % nickel (Ni), and greater than or equal to 22 wt % cobalt (Co), wherein the electrode material has a coefficient of thermal expansion (CTE) from room temperature to 200° C. that is less than or equal to $11.0\times10^{-6}/°$ C.

In some embodiments, the electrode material includes 22-29 wt % iron (Fe), inclusive, 24-32 wt % nickel (Ni), inclusive, 28-42 wt % cobalt (Co), inclusive, 3-7 wt % aluminum (Al), inclusive, 0.05-0.5 wt % titanium (Ti), inclusive, 2-4 wt % chromium (Cr), inclusive, 0.002-0.015 wt % boron (B), inclusive, and 2-4 wt % niobium (Nb), inclusive.

In some embodiments, the electrode material includes 32-46 wt % iron (Fe), inclusive, 36-40 wt % nickel (Ni), inclusive, 13-17 wt % cobalt (Co), inclusive, 2-6 wt % aluminum (Al), inclusive, 1-1.85 wt % titanium (Ti), inclusive, and 2.4-3.5 wt % niobium (Nb), inclusive.

According to one embodiment, there is provided a spark plug comprising a shell, an insulator disposed at least partially within the shell, a center electrode disposed at least partially within the insulator, and a ground electrode configured to form a spark gap that is located between the ground electrode and the center electrode. An electrode material for the center electrode, for the ground electrode, or for both the center electrode and the ground electrode includes greater than or equal to 32 wt % iron (Fe), greater than or equal to 36 wt % nickel (Ni), and one or more additional elements selected from aluminum (Al), chromium (Cr), and cobalt (Co). The electrode material has a coefficient of thermal expansion (CTE) from room temperature to 200° C. that is less than or equal to $9.0\times10^{-6}/°$ C.

In some embodiments, the electrode material includes greater than or equal to 22 wt % cobalt (Co).

In some embodiments, the electrode material includes 32-46 wt % iron (Fe), inclusive, 36-40 wt % nickel (Ni), inclusive, 13-17 wt % cobalt (Co), inclusive, 2-6 wt % aluminum (Al), inclusive, 1-1.85 wt % titanium (Ti), inclusive, and 2.4-3.5 wt % niobium (Nb), inclusive.

In some embodiments, the electrode includes 47-56 wt % iron (Fe), inclusive, 40-45 wt % nickel (Ni), inclusive, 4-6 wt % chromium (Cr), inclusive, and 0-2 wt % aluminum (Al), inclusive.

In some embodiments, the electrode material has a coefficient of thermal expansion (CTE) from room temperature to 800° C. that is less than or equal to $13.7\times10^{-6}$/° C.

It is contemplated that any number of the individual features of the above-described embodiments and of any other embodiments depicted in the drawings or description below can be combined in any combination to define an invention, except where features are incompatible.

DRAWINGS

Example embodiments will hereinafter be described in conjunction with the appended drawings, wherein like designations denote like elements, and wherein.

DESCRIPTION

Figure 1:
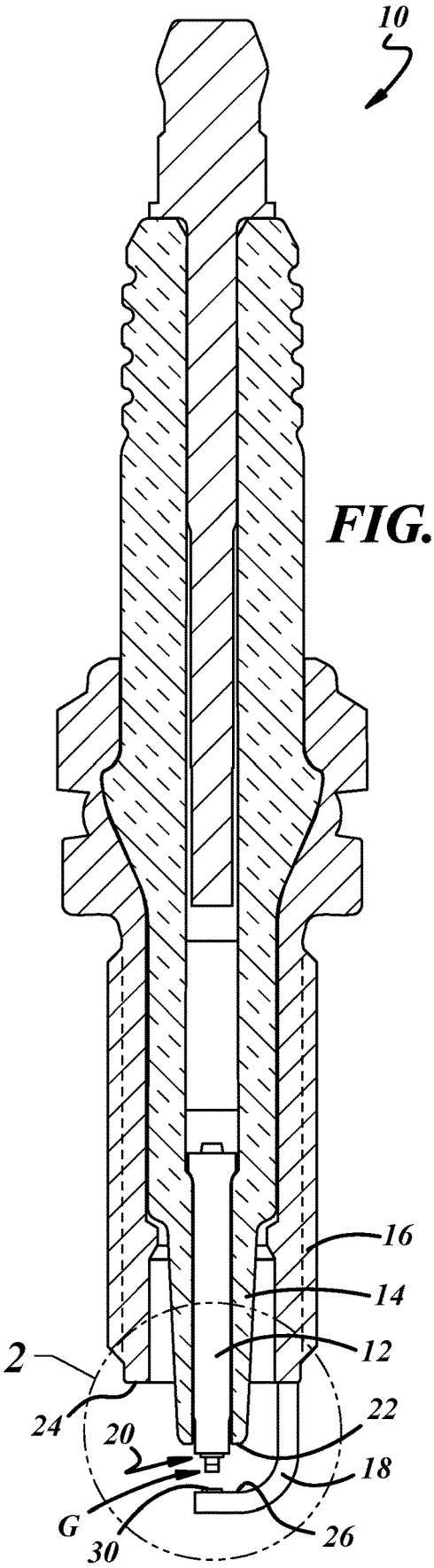
FIG. 1 is a cross-section view of a spark plug according to one embodiment.

The electrode materials described herein are designed to have a relatively low coefficient of thermal expansion (CTE) and a relatively high corrosion resistance. The electrode materials, according to one embodiment, include iron-nickel-cobalt alloys with a low CTE threshold that can promote a stronger junction between the electrode and a precious metal firing tip. The addition of cobalt in particular amounts, to replace some nickel in the alloy, can enhance the thermal stability of the electrode materials. The four example electrode materials described herein maintain a lower CTE over larger temperature ranges than other electrode materials, which can improve spark plug life and performance, particularly when a precious metal firing tip is used. Further, in some instances, the four example electrode materials can be used for a center or ground electrode without the need for an intervening pad or layer between the electrode and a precious metal firing tip. Such intervening layers are oftentimes used to address CTE differentials, and require additional manufacturing steps. The electrode materials described herein can be directly welded or otherwise joined to a precious metal firing tip, while minimizing the CTE differential.

The electrode materials are designed for use in spark plugs and other ignition devices including industrial plugs, aviation igniters, glow plugs, or any other device that is used to ignite an air/fuel mixture in an engine. This includes, but is certainly not limited to, the example automotive spark plugs that are shown in the drawings and are described below. Furthermore, it should be appreciated that the electrode materials may be used in a center and/or ground electrode or in a firing tip that is attached to a center and/or ground electrode (this includes both single component firing tips and multi-component firing tips), to cite several possibilities. Other embodiments and applications of the electrode materials are also possible. Unless otherwise specified, all percentages provided herein are in terms of weight percentage (wt %).

Figure 2:
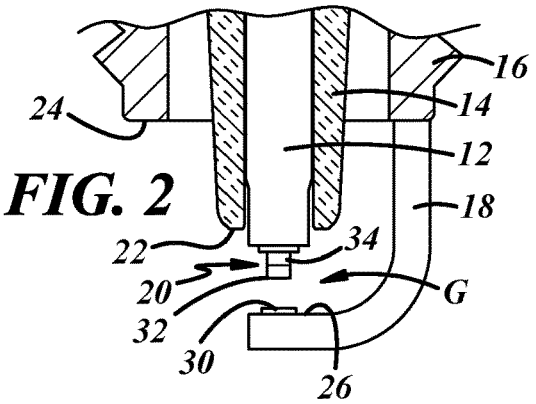
FIG. 2 is a partial cross-section view of a spark plug according to another embodiment.

Referring to FIGS. 1 and 2, there is shown an example spark plug 10 that includes a center electrode 12, an insulator 14, a metallic shell 16, and a ground electrode 18. The center electrode or base electrode member 12 is disposed within an axial bore of the insulator 14 and includes a firing tip 20 that protrudes beyond a free end 22 of the insulator 14. The firing tip 20 is a multi-piece rivet that includes a first component 32 made from an erosion- and/or corrosion-resistant material, such a noble metal-based material, and a second component 34 made from an intermediary or electrode material, like the electrode materials described herein. In this particular embodiment, the first component 32 has a cylindrical shape and the second component 34 has a stepped or rivet shape that includes a diametrically-enlarged head section and a diametrically-reduced stem section. The first and second components may be attached to each other via a laser weld and/or a resistance weld, or some other suitable welded or non-welded joint. Insulator 14 is disposed within an axial bore of the metallic shell 16 and is constructed from a material, such as a ceramic material, that is sufficient to electrically insulate the center electrode 12 from the metallic shell 16. The free end 22 of the insulator 14 may protrude beyond a free end 24 of the metallic shell 16, as shown, or it may be retracted within the metallic shell 16. The ground electrode or base electrode member 18 may be constructed according to the conventional J-gap configuration shown in the drawings or according to some other arrangement, and is attached to the free end 24 of the metallic shell 16. According to this particular embodiment, the ground electrode 18 includes a side surface 26 that opposes the firing tip 20 of the center electrode and has a firing tip 30 attached thereto. The firing tip 30 is in the form of a flat pad and defines a spark gap G with the center electrode firing tip 20 such that they provide sparking surfaces for the emission, reception, and exchange of electrons across the spark gap.

In this particular embodiment, any combination of the center electrode 12, the ground electrode 18, and/or the second component 34 of the multi-piece firing tip 20 may be made from the electrode materials described herein. It is also possible for the first component 32 of the multi-piece firing tip 20 and/or the firing tip 30 to be made from the present electrode materials as well. Skilled artisans will appreciate, however, that the electrode materials taught herein are not limited to the specific components of FIGS. 1 and 2, as there are countless other ways to potentially use and implement such electrode materials. For example, the present electrode materials may be used to form: center and/or ground electrodes; electrodes with or without thermally conducting cores (e.g., copper cores); electrodes with or without noble metal tips (e.g., tips in the shape of rivets, cylinders, bars, columns, wires, balls, mounds, cones, flat pads, disks, rings, sleeves, etc.); electrodes with or without stress relieving or intermediate layers; electrodes with or without holes, recesses or pockets formed therein; electrodes with or without standard J-gap configurations; various types of firing tips; or some other spark plug piece or component. As used herein, the term "electrode"—whether pertaining to a center electrode, a ground electrode, a spark plug electrode, etc.—may include a base electrode member by itself, a firing tip by itself, or a combination of a base electrode member and one or more firing tips attached thereto, to cite several possibilities.

Figure 3:
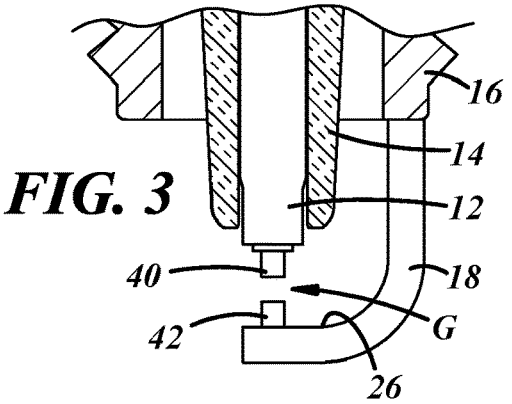
FIG. 3 is a partial cross-section view of a spark plug according to another embodiment.

FIGS. 3-12 show some other possible spark plug embodiments, each of which may be provided with the electrode materials described herein. Turning to FIG. 3, there is shown a firing end of a spark plug where the center and ground electrodes 12, 18 are provided with single piece firing tips 40, 42, respectively. In this particular embodiment, the firing tips 40, 42 may each be in the shape of a rivet or column, and the center electrode 12, the ground electrode 18, the center electrode firing tip 40, the ground electrode firing tip 42, or any combination thereof may be made from and/or otherwise include the present electrode materials.

Figure 4:
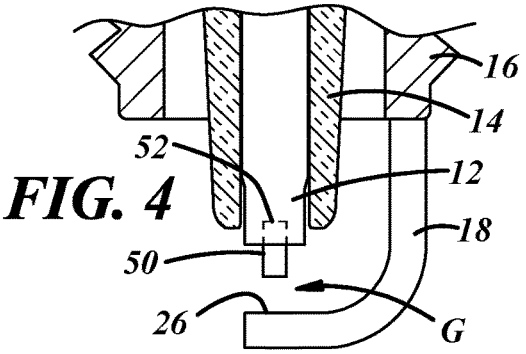
FIG. 4 is a partial cross-section view of a spark plug according to another embodiment.

In FIG. 4, a firing end of a spark plug is shown where a firing tip 50 is inserted into a blind hole 52 formed in a distal end surface of the center electrode; in this non-limiting embodiment, the ground electrode 18 does not include a separate firing tip. It should be appreciated that the center electrode 12, the ground electrode 18, the center electrode firing tip 50, or any combination thereof may be made from and/or otherwise include the present electrode materials.

Figure 5:
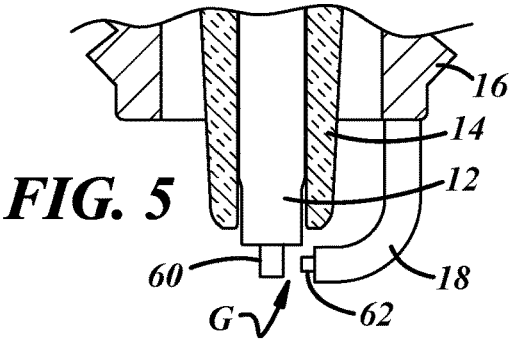
FIG. 5 is a partial cross-section view of a spark plug according to another embodiment.

With reference to the embodiment of FIG. 5, the spark plug includes a ground electrode 18 that is bent inwards such that its distal end surface includes a ground electrode firing tip 62 that opposes a side surface of a center electrode firing tip 60. In this example, the center electrode 12, the ground electrode 18, the center electrode firing tip 60, the ground electrode firing tip 62, or any combination thereof may be made from and/or otherwise include the present electrode materials.

Figure 6:
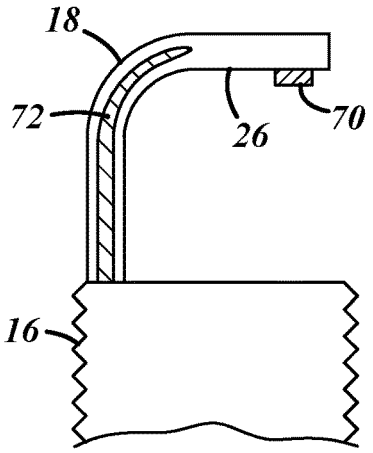
FIG. 6 is a partial cross-section view of a spark plug ground electrode according to one embodiment.

FIG. 6 shows an embodiment a ground electrode firing tip 70 in the shape of a flat pad attached to a ground electrode 18 with a thermally conductive core section 72 (e.g., a copper core section). It is possible for the ground electrode 18, the ground electrode firing tip 70, or any combination thereof to be made from and/or otherwise include the present electrode materials.

Figure 7:
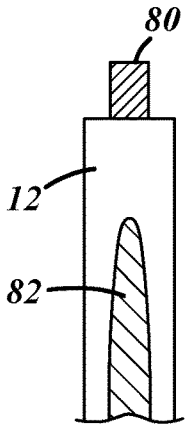
FIG. 7 is a partial cross-section view of a spark plug center electrode according to one embodiment.
Figure 8:
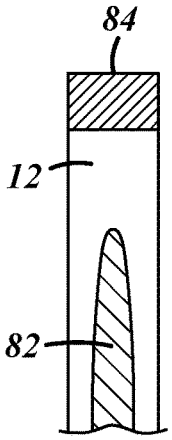
FIG. 8 is a partial cross-section view of a spark plug center electrode according to another embodiment.

FIGS. 7 and 8, on the other hand, show different examples of possible center electrode assemblies. In FIG. 7, the center electrode assembly includes a center electrode 12 with a reduced diameter center electrode firing tip 80 and a thermally conductive core section 82, whereas the FIG. 8 embodiment shows a center electrode assembly with a center electrode 12 having a same diameter center electrode firing tip 84 and a thermally conductive core section 82. In these embodiments, the center electrode 12, the center electrode firing tip 80, 84, or any combination thereof may be made from and/or otherwise include the present electrode materials.

Figure 9:
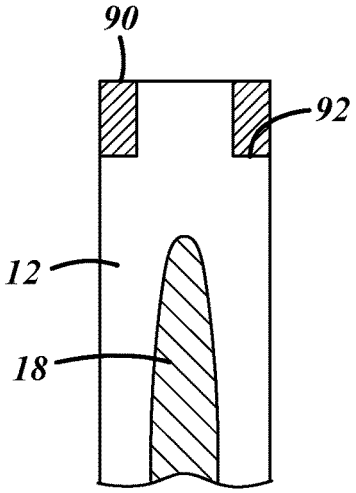
FIG. 9 is a partial cross-section view of a spark plug center electrode according to another embodiment.

Turning to FIG. 9, there is shown an example of a center electrode assembly where the center electrode 12 includes a thermally conductive core section 82 and a center electrode firing tip 90 in the form of an annular sleeve or ring. The center electrode firing tip 90 may, like all of the firing tips, be made from some type of precious or noble metal composition and is configured to seat in an annular groove or channel 92 located towards the distal end of the center electrode. In this example, the center electrode 12, the center electrode firing tip 90, or any combination thereof may be made from and/or otherwise include the present electrode materials.

Figure 10:
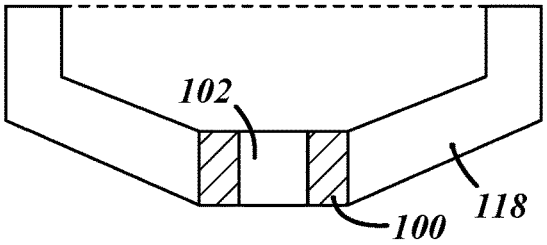
FIG. 10 is a partial cross-section view of a spark plug ground electrode according to another embodiment.
Figure 11:
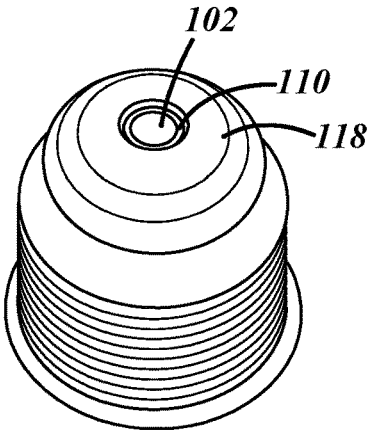
FIG. 11 is a partial cross-section view of a spark plug ground electrode according to another embodiment.

In the embodiments of FIGS. 10 and 11, annular type ground electrodes 118 are shown having ground electrode firing tips 100, 110 that are annular or ring-shaped and surround an opening 102 near where a corresponding center electrode would be located. In these particular examples, the ground electrodes 118, the ground electrode firing tips 100, 110 or any combination thereof may be made from and/or otherwise include the present electrode materials.

Figure 12:
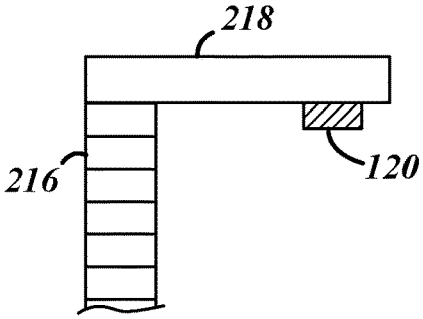
FIG. 12 shows a spark plug ground electrode according to another embodiment.

FIG. 12 is yet another embodiment of a potential ground electrode assembly where a ground electrode 218 is connected to an extension portion of a shell 216 such that the ground electrode is straight and extends in a direction that is perpendicular to the longitudinal axis of the spark plug. In this particular example, a ground electrode firing tip 120 in the shape of a flat pad is attached to an inner surface of the ground electrode 218 so that it may face a corresponding center electrode firing tip (not shown) across a spark gap. The shell or shell extension 216, the ground electrode 218, the ground electrode firing tip 120, or any combination thereof may be made from and/or otherwise include the present electrode materials.

It should be appreciated that the electrode materials described herein are not limited to any particular spark plug configuration and that the non-limiting configurations shown in FIGS. 1-12 have been provided to merely illustrate some of the possible applications and uses for such electrode materials. Numerous other configurations and examples are possible as well. In advantageous embodiments, the four example electrode materials below are used for a ground and/or center electrode with a precious metal firing tip. An Ir-based or Pt-based firing tip with the four electrode materials below in particular, including all of their respective constituents, can help minimize the CTE differential while maintaining good oxidation and erosion performance.

In spark plugs, noble or precious metal tips or pieces are oftentimes mounted to electrodes to improve the corrosion and/or erosion performance of the plug. Due to the relatively large discrepancy in the coefficient of thermal expansion (CTE) between the electrode alloy and the noble or precious metal alloy, the noble or precious metal tips can crack or become weakened at the welding interface such that they fall off during use in the engine. This is because spark plug electrodes are exposed to substantial thermo-mechanical stresses during engine use caused by extreme cold/hot thermal cycling (e.g., the temperature swings in an automotive spark plug electrode can be more than 700° C.). Different CTEs between the electrode and the noble metal tip cause the joined materials to expand at different rates, thus, leading to thermo-mechanical stresses at the welded interface. To illustrate, noble or precious metals such as iridium and platinum typically exhibit a relatively low CTE (e.g., for iridium, from room temperature to 800° C. exhibits a CTE of about $7.5\times10^{-6}$/° C.; for platinum, from room temperature to 800° C. the CTE is about $10.06\times10^{-6}$/° C.; for platinum-based alloys with an iridium addition of 10-30 wt %, from room temperature to 800° C. the CTE is about $8.1\text{-}8.7\times10^{-6}$/° C.;), whereas nickel-based alloys commonly used to make spark plug electrodes are typically much higher (e.g., INCONEL 600, from room temperature to 800°

C. is about $16.1\times10^{-6}$/° C. and INCONEL 601, from room temperature to 800° C. is about $16.67\times10^{-6}$/° C.). Additionally, the extreme environment surrounding the spark plug electrodes in terms of temperature, pressure, combustion, etc. can cause corrosive byproducts to build up and form on the electrode surfaces which, in turn, can further weaken or degrade the spark plug electrodes.

The electrode materials disclosed herein address the aforementioned challenges and are well suited for use in spark plug electrodes. By exhibiting a relatively low CTE, the present electrode materials are able to reduce the difference or delta between their properties and those of the adjoined spark plug components, so that the thermo-mechanical stresses experienced by the spark plug during engine use are reduced. This can be particularly true at an electrode/precious metal based interface or welded junction. According to one embodiment, the electrode material is a high temperature alloy for use in a spark plug or ignition device that includes cobalt (Co), nickel (Ni) and iron (Fe), as well as one or more additional constituents, and exhibits a CTE from room temperature to 800° C. of less than $15.0\times10^{-6}$/° C. Replacing at least some nickel with more significant amounts of cobalt (Co) (e.g., greater than 13 wt %, or more advantageously, greater than 22 wt % or 28 wt %), helps achieve this lower CTE and improve the thermal stability of the alloy.

A first example of the electrode material is a high temperature cobalt-nickel-iron alloy having cobalt (Co) 28-42% wt %, nickel (Ni) 24-32 wt % and iron (Fe) 22-29 wt %, as well as additional constituents like chromium (Cr) 2-4 wt %, aluminum (Al) 3-7 wt %, niobium (Nb) 2-4 wt %, titanium (Ti) 0.05-0.5 wt %, boron (B) 0.002-0.015 wt % and/or trace elements. This example high temperature cobalt-nickel-iron alloy, including all of the constituent elements above, has CTEs that range from $10.10\text{-}10.35\times10^{-6}$/° C. from room temperature to 200° C., $10.4\text{-}10.7\times10^{-6}$/° C. from room temperature to 400° C., $12.3\text{-}12.6\times10^{-6}$/° C. from room temperature to 600° C., and $14.0\text{-}14.4\times10^{-6}$/° C. from room temperature to 800° C. Maintaining a lower CTE over such a wide temperature range (e.g., room temperature to 800° C.) can be more difficult in some instances than maintaining an even lower CTE over a narrower temperature range (e.g., room temperature to 200° C.). Moreover, a more stable alloy at an 800° C. temperature range for the CTE may perform better in the cyclic thermal environment of the internal combustion engine. As demonstrated by the preceding CTE values, the electrode material of this example, which includes all of the constituents listed above with respect to the first example, has a more similar and, thus, more compatible set of thermo-mechanical properties with noble or precious metals, such as iridium and platinum, such that thermo-mechanical stress or forces on the welded interface between such materials is lower than many traditional spark plugs. Moreover, this electrode material example exhibits a thermal conductivity of about 27 W/m° C. at 800° C., which is very suitable for spark plug applications.

When alloyed with the cobalt, nickel, and iron in this example, the other constituents make valuable contributions to the high temperature alloy so that it can perform well in the harsh environment of the engine. For instance, the chromium 2-4 wt %, the aluminum 3-7 wt % and/or the niobium 2-4 wt % and can provide resistance to corrosion due to one or more layers of oxide that can form on the surface. It can also improve the strength of such alloys, particularly at low temperatures, and coupled with its impassivity and high melting point, it is particularly well suited for use with the electrode material disclosed herein. Small amounts of silicon may also be included to help form a stable oxide layer. The titanium in this example is present in the amount of 0.05-0.4 wt % and can contribute to the strength of the electrode material, particularly when coupled with aluminum and iron. Boron in the amount of 0.002-0.015 wt % can act as a grain boundary strengthener and, as such, it can strengthen grain boundaries, prevent or retard grain boundary sliding and allow for stress relaxation along the grain boundaries, to cite a few possibilities. Titanium and niobium, in the prescribed amounts noted above, may precipitate along the grain boundaries and enhance stress rupture properties. These and other material properties of the constituents described above positively contribute to the electrode material in the form of the high temperature Co—Ni—Fe alloy such that it can be successfully used in a spark plug electrode.

A second example of the electrode material is a high temperature iron-cobalt-nickel alloy having iron (Fe) 35-45 wt %, cobalt (Co) 22-35 wt % and nickel (Ni) 20-30 wt %, as well as additional constituents like chromium (Cr) 4-7 wt % and aluminum (Al) 0.5-2 wt %. This high temperature alloy example, including all of the constituents of the second example above, has a CTE of about $7.7\times10^{-6}$/° C. from room temperature to 200° C., about $9.3\times10^{-6}$/° C. from room temperature to 400° C., about $11.7\times10^{-6}$/° C. from room temperature to 600° C., and about $14.2\times10^{6}$/° C. from room temperature to 800° C.

When alloyed with the other constituents of this example, each of the elements plays a useful and potentially unique role. For example, in this second example where the amount of iron is 35-45 wt %, which is the single largest constituent on a weight basis, the alloy can exhibit high resistance to abrasion or impact due, at least in part, to the contribution of the iron. Iron is also relatively inexpensive, which makes it appealing for large scale manufacturing. The cobalt is in a range of 22-35 wt % and can provide good mechanical strength at high temperatures, which is ideal for spark plug electrodes. Nickel in the range of 20-30 wt % can be beneficial for several reasons, including because of its relatively low cost and its corrosion resistance, which can prolong the life and durability of the spark plug.

A third example of the electrode material is a high temperature iron-nickel-cobalt alloy having iron (Fe) 32-46 wt %, nickel (Ni) 36-40 wt %, cobalt (Co) 13-17 wt % and as well as additional constituents like niobium (Nb) 2.4-3.5 wt % and titanium (Ti) 1-1.85 wt %, and aluminum (Al) 2-6 wt %. This high temperature alloy example, including all of the constituents of example three above, has a CTE of about $7.1\times10^{-6}$/° C. from room temperature to 200° C., about $6.9\times10^{-6}$/° C. from room temperature to 400° C., about $7.0\text{-}8.0\times10^{-6}$/° C. from room temperature to 425° C., about $9.5\times10^{-6}$/° C. from room temperature to 600° C., and about $12.0\times10^{6}$/° C. from room temperature to 800° C.

According to another embodiment or fourth example, the electrode material is a high temperature alloy for use in a spark plug or ignition device that includes iron (Fe) and nickel (Ni), as well as one or more additional constituents. A fourth example of the electrode material is a high temperature iron-nickel alloy having iron (Fe) 47-56 wt % and nickel (Ni) 40-45 wt %, as well as additional constituents like chromium (Cr) 4-6 wt % and aluminum (Al) 0-2 wt %. This high temperature alloy example, including all of the constituents of the fourth example above, has a CTE of about $8.0\times10^{-6}$/° C. from room temperature to 200° C., about $8.2\times10^{-6}/°$ C. from room temperature to 300° C., about $10.0\times10^{-6}/°$ C. from room temperature to 400° C., about $12.2\times10^{6}/°$ C. from room temperature to 600° C., and about $13.7\times10^{-6}/°$ C. from room temperature to 800° C.

All of the examples above possess low coefficients of thermal expansion (CTEs) and high oxidation and corrosion resistance, which makes them good options for an electrode material where it is desirable to minimize the CTE mismatch with one or more noble or precious metal based tips. The low CTE of the four example electrode materials above is more comparable to the CTE of a precious metal alloy, even though the electrode material is not precious metal based. Moreover, in the specific four examples above, in particular, the electrode material advantageously does not include a substantial amount (or any) of the following precious metals, either individually or in combination (i.e., does not include more than 10 wt %): platinum (Pt), iridium (Ir), gold (Au), silver (Ag), palladium (Pd), ruthenium (Ru), or rhodium (Rh). This can lower the cost of the electrode material. Additionally, the inclusion of higher amounts of cobalt (Co) in the alloy (more particularly, greater than or equal to 13 wt %, or even more particularly, greater than or equal to 22 wt % or 28 wt %) can balance the phase equilibrium of the electrode material, and results in a more thermodynamically stable alloy.

As explained above, the spark plug may include a center electrode assembly having a center electrode with a center electrode firing tip attached thereto, a ground electrode assembly having a ground electrode with a ground electrode firing tip attached thereto, or both. If the spark plug includes such a center or ground electrode assembly, then there is a junction or boundary between the material of the base electrode and the material of the firing tip. In such a case, it may be preferable to have a ratio of the base electrode CTE at 800° C. to the firing tip CTE at 800° C. that is less than 2.0.

It is to be understood that the foregoing is a description of one or more preferred example embodiments of the invention. The invention is not limited to the particular embodiment(s) disclosed herein, but rather is defined solely by the claims below. Furthermore, the statements contained in the foregoing description relate to particular embodiments and are not to be construed as limitations on the scope of the invention or on the definition of terms used in the claims, except where a term or phrase is expressly defined above. Various other embodiments and various changes and modifications to the disclosed embodiment(s) will become apparent to those skilled in the art. All such other embodiments, changes, and modifications are intended to come within the scope of the appended claims.

As used in this specification and claims, the terms "for example," "e.g.," "for instance," "such as," and "like," and the verbs "comprising," "having," "including," and their other verb forms, when used in conjunction with a listing of one or more components or other items, are each to be construed as open-ended, meaning that that the listing is not to be considered as excluding other, additional components or items. Other terms are to be construed using their broadest reasonable meaning unless they are used in a context that requires a different interpretation. In addition, the term "and/or" is to be construed as an inclusive OR. Therefore, for example, the phrase "A, B, and/or C" is to be interpreted as covering all the following: "A"; "B"; "C"; "A and B"; "A and C"; "B and C"; and "A, B, and C."

What is claimed is:

1. A spark plug, comprising:

a shell;

an insulator disposed at least partially within the shell;

a center electrode disposed at least partially within the insulator; and a ground electrode configured to form a spark gap (G) that is located between the ground electrode and the center electrode, wherein an electrode material for the center electrode, for the ground electrode, or for both the center electrode and the ground electrode includes 22-46 wt % iron (Fe), inclusive, 20-40 wt % nickel (Ni), inclusive, 13-42 wt % cobalt (Co), inclusive, and one or more additional elements selected from aluminum (Al), titanium (Ti), chromium (Cr), boron (B), and niobium (Nb), wherein the electrode material has a coefficient of thermal expansion (CTE) from room temperature to 200° C. that is less than or equal to $11.0\times10^{-6}/°$ C.

2. The spark plug of claim 1, wherein the electrode material includes greater than or equal to 22 wt % cobalt (Co).

3. The spark plug of claim 1, wherein the electrode material includes 22-9 wt % iron (Fe), inclusive, 24-32 wt % nickel (Ni), inclusive, 28-42 wt % cobalt (Co), inclusive, 3-7 wt % aluminum (Al), inclusive, 0.05-0.5 wt % titanium (Ti), inclusive, 2-4 wt % chromium (Cr), inclusive, 0.002-0.015 wt % boron (B), inclusive, and 2-4 wt % niobium (Nb), inclusive.

4. The spark plug of claim 3, wherein the coefficient of thermal expansion (CTE) from room temperature to 200° C. is between $10.10\text{-}10.35\times10^{-6}/°$ C., inclusive.

5. The spark plug of claim 3, wherein the electrode material has a coefficient of thermal expansion (CTE) from room temperature to 800° C. that is between $14.0\text{-}14.4\times10^{-6}/°$ C., inclusive.

6. The spark plug of claim 1, wherein the electrode material includes 35-45 wt % iron (Fe), inclusive, 20-30 wt % nickel (Ni), inclusive, 22-35 wt % cobalt (Co), inclusive, 0.5-2 wt % aluminum (Al), inclusive, and 4-7 wt % chromium (Cr), inclusive.

7. The spark plug of claim 6, wherein the electrode material has a coefficient of thermal expansion (CTE) from room temperature to 200° C. that is less than or equal to $8.0\times10^{-6}/°$ C.

8. The spark plug of claim 6, wherein the electrode material has a coefficient of thermal expansion (CTE) from room temperature to 800° C. that is less than or equal to $15.0\times10^{-6}/°$ C.

9. The spark plug of claim 6, wherein the electrode material has a coefficient of thermal expansion (CTE) from room temperature to 800° C. that is less than or equal to $12.0\times10^{-6}/°$ C.

10. The spark plug of claim 9, wherein a firing tip made from a precious metal based material is attached to the ground electrode or the center electrode, wherein the precious metal based material has a coefficient of thermal expansion (CTE) from room temperature to 200° C., and wherein a ratio of the CTE for the precious metal based material to the CTE of the electrode material is less than 2.0.

11. The spark plug of claim 1, wherein the electrode material includes 32-46 wt % iron (Fe), inclusive, 36-40 wt % nickel (Ni), inclusive, 13-17 wt % cobalt (Co), inclusive, 2-6 wt % aluminum (Al), inclusive, 1-1.85 wt % titanium (Ti), inclusive, and 2.4-3.5 wt % niobium (Nb), inclusive.

12. The spark plug of claim 11, wherein the electrode material has a coefficient of thermal expansion (CTE) from room temperature to 425° C. that is between 7-8×$10^{-6}$/° C., inclusive.

13. A spark plug, comprising:

a shell;

an insulator disposed at least partially within the shell;

a center electrode disposed at least partially within the insulator; and a ground electrode configured to form a spark gap (G) that is located between the ground electrode and the center electrode, wherein an electrode material for the center electrode, for the ground electrode, or for both the center electrode and the ground electrode includes greater than or equal to 22 wt % iron (Fe), greater than or equal to 20 wt % nickel (Ni), and greater than or equal to 22 wt % cobalt (Co), wherein the electrode material has a coefficient of thermal expansion (CTE) from room temperature to 200° C. that is less than or equal to 11.0×$10^{-6}$/° C.

14. The spark plug of claim 13, wherein the electrode material includes 22-29 wt % iron (Fe), inclusive, 24-32 wt % nickel (Ni), inclusive, 28-42 wt % cobalt (Co), inclusive, 3-7 wt % aluminum (Al), inclusive, 0.05-0.5 wt % titanium (Ti), inclusive, 2-4 wt % chromium (Cr), inclusive, 0.002-0.015 wt % boron (B), inclusive, and 2-4 wt % niobium (Nb), inclusive.

15. The spark plug of claim 13, wherein the electrode material includes 32-46 wt % iron (Fe), inclusive, 36-40 wt % nickel (Ni), inclusive, 13-17 wt % cobalt (Co), inclusive, 2-6 wt % aluminum (Al), inclusive, 1-1.85 wt % titanium (Ti), inclusive, and 2.4-3.5 wt % niobium (Nb), inclusive.

16. A spark plug, comprising:

a shell;

an insulator disposed at least partially within the shell;

a center electrode disposed at least partially within the insulator; and a ground electrode configured to form a spark gap (G) that is located between the ground electrode and the center electrode, wherein an electrode material for the center electrode, for the ground electrode, or for both the center electrode and the ground electrode includes greater than or equal to 32 wt % iron (Fe), greater than or equal to 36 wt % nickel (Ni), and one or more additional elements selected from aluminum (Al), chromium (Cr), and cobalt (Co), wherein the electrode material has a coefficient of thermal expansion (CTE) from room temperature to 200° C. that is less than or equal to 9.0×$10^{-6}$/° C.

17. The spark plug of claim 16, wherein the electrode material includes greater than or equal to 22 wt % cobalt (Co).

18. The spark plug of claim 16, wherein the electrode material includes 32-46 wt % iron (Fe), inclusive, 36-40 wt % nickel (Ni), inclusive, 13-17 wt % cobalt (Co), inclusive, 2-6 wt % aluminum (Al), inclusive, 1-1.85 wt % titanium (Ti), inclusive, and 2.4-3.5 wt % niobium (Nb), inclusive.

19. The spark plug of claim 16, wherein the electrode includes 47-56 wt % iron (Fe), inclusive, 40-45 wt % nickel (Ni), inclusive, 4-6 wt % chromium (Cr), inclusive, and 0-2 wt % aluminum (Al), inclusive.

20. The spark plug of claim 19, wherein the electrode material has a coefficient of thermal expansion (CTE) from room temperature to 800° C. that is less than or equal to 13.7×$10^{-6}$/° C.

* * * * *